US007418379B2

(12) United States Patent
Vierthaler

(10) Patent No.: US 7,418,379 B2
(45) Date of Patent: Aug. 26, 2008

(54) CIRCUIT FOR IMPROVING THE INTELLIGIBILITY OF AUDIO SIGNALS CONTAINING SPEECH

(75) Inventor: Matthias Vierthaler, Freiburg (DE)

(73) Assignee: Micronas GmbH, Freiburg (DE)

( * ) Notice: Subject to any disclaimer, the term of this patent is extended or adjusted under 35 U.S.C. 154(b) by 770 days.

(21) Appl. No.: 10/152,159

(22) Filed: May 20, 2002

(65) Prior Publication Data

US 2002/0173950 A1 Nov. 21, 2002

(30) Foreign Application Priority Data

May 18, 2001 (DE) ..... 101 24 699

(51) Int. Cl.
*G10L 19/00* (2006.01)

(52) U.S. Cl. ..... 704/225; 704/200; 704/270

(58) Field of Classification Search ..... 704/231, 704/270, 503, 200, 225
See application file for complete search history.

(56) References Cited

U.S. PATENT DOCUMENTS

| | | | | |
|---|---|---|---|---|
| 3,678,416 | A * | 7/1972 | Burwen | 333/17.1 |
| 3,696,252 | A * | 10/1972 | Chapman | 327/309 |
| 3,946,249 | A * | 3/1976 | Nagami et al. | 327/553 |
| 4,454,609 | A | 6/1984 | Kates | 381/68 |
| 4,471,171 | A * | 9/1984 | Kopke et al. | 381/60 |
| 4,539,526 | A | 9/1985 | Davis | 330/144 |
| 5,083,312 | A | 1/1992 | Newton et al. | 381/68.4 |
| 5,170,434 | A | 12/1992 | Anderson | 381/68 |
| 5,305,420 | A * | 4/1994 | Nakamura et al. | 704/271 |
| 5,406,633 | A * | 4/1995 | Miller et al. | 381/320 |
| 5,459,813 | A | 10/1995 | Klayman | 395/2.18 |
| 5,479,560 | A | 12/1995 | Mekata | 395/2.18 |
| 5,553,151 | A | 9/1996 | Goldberg | 381/68.4 |
| 5,796,842 | A | 8/1998 | Hanna | 381/4 |
| 6,118,879 | A | 9/2000 | Hanna | 381/106 |
| 7,110,951 | B1 * | 9/2006 | Lemelson et al. | 704/270 |

FOREIGN PATENT DOCUMENTS

DE 3927765 3/1990

OTHER PUBLICATIONS

Kretsinger, Elwood et. al: "The Use of Fast Limiting to Improve the Intelligibility of Speech in Noise," Speech Monographs, Mar. 1960.
Licklider, J.C.: "Effects of Amplitude Distortion upon the Intelligibility of Speech," Journal of Acoustical Society of America, Oct. 1946.
Thomas, Ian et. al.: "The Intelligibility of Filtered-Clipped Speech in Noise," The Journal of the Audio Engineering Society, Jun. 1970.
Thomas, Ian et. al.: "Intelligibility Enhancement Through Spectral Weighting," Proceedings of the 1972, IEEE Conference on Speech Communication and Processing.

* cited by examiner

*Primary Examiner*—Daniel D Abebe
(74) *Attorney, Agent, or Firm*—O'Shea, Getz & Kosakowski, P.C.

(57) ABSTRACT

The speech intelligibility of an audio signal of unchanged volume is improved by raising the total audio signal by a constant factor and lowering the amplitude of this raised signal by a high-pass filter. The corner frequency $f_c$ of the high-pass filter is adjusted such that the output amplitude of the audio signal at the end of the processing segment is equal or proportional to the input amplitude of the audio signal.

22 Claims, 2 Drawing Sheets

CIRCUIT FOR IMPROVING THE INTELLIGIBILITY OF AUDIO SIGNALS CONTAINING SPEECH

BACKGROUND OF THE INVENTION

The present invention relates to the field of signal processing, and in particular to signal processing of audio signals containing speech.

There are a variety of approaches to improving the speech intelligibility of audio signals. One approach is to improve the noisy audio signal. Another approach is to improve the signals that have been degraded by reverberation and echoes, etc. Yet another approach is that a good audio signal may be modified to make it more intelligible for the hearing-impaired—a method used, for example, in hearing aids. It is also possible to modify a good audio signal so it is more intelligible in the presence of high background noise.

U.S. Pat No. 5,459,813 discloses that "unvoiced sounds" (e.g., consonants) are masked by much stronger "voiced sounds" (e.g., vowels). Since unvoiced sounds are critical for the intelligibility of speech, this patent disclose enhancing these sounds, for example, by clipping or amplitude compression.

The publication entitled "Effects of Amplitude Distortion upon Intelligibility of Speech" by J. C. Liqulider in the *Journal of the Acoustical Society of America*, October 1946 discloses "peak clipping". This peak clipping without ambient noise has little effect on the intelligibility of speech. Peak clipping at −20 dB still yields approximately 96% intelligibility. "Center clipping" is considerably worse since the consonants are removed, which are especially critical to intelligibility. Peak clipping at −24 dB requires amplification of only approximately 14 dB to obtain the same intelligibility. In the publication *Speech Monographs*, March 1960, the article by Elwood Kretsinger et al. entitled "The Use of Fast Limiting to Improve the Intelligibility of Speech in Noise" discloses that consonants are approximately 12 dB weaker than vowels. Thus, by amplifying the consonants relative to the vowels, the intelligibility of speech in the audio signal is increased. Replacing the clipper with a fast peak limiter (22 msec.) enables intelligibility to be increased still further. At −10 dB limiting, intelligibility is increased from 56% to 84%.

From the article by Ian Thomas et al., entitled "The Intelligibility of Filtered-Clipped Speech in Noise" in the *Journal of the Audio Engineering Society*, June 1970, it is known that the fundamental wave of an audio signal that contains speech contributes very little to speech intelligibility, while the first resonance frequency is extremely important. For this reason, the signal should be high-pass-filtered before clipping.

From the article by Ian Thomas et al., entitled "Intelligibility Enhancement through Spectral Weighting," in the *Proceedings of the* 1972 *IEEE Conference on Speech Communication and Processing*, it is known that, while clipping does improve the intelligibility of speech, it also degrades signal quality. Therefore, this publication proposes shifting the signal energy into the significant frequency ranges.

U.S. Pat. No. 5,479,560 discloses an approach in which the audio signals are broken up into multiple frequency bands, and the high-energy frequency bands are amplified relatively strongly while the others are lowered. This technique is based on the fact that speech is composed of a sequence of phonemes. Phonemes consist of a plurality of frequencies that undergo significant amplification at the resonance frequencies of the mouth and throat cavity. A frequency band with this type of spectral peak is called a formant. Formants are especially important for the recognition of phonemes and thus speech. Therefore, one approach to improving speech intelligibility involves amplifying the peaks (formants) of the frequency spectrum of an audio signal while attenuating the intermediate valleys. For an adult male, the fundamental frequency of speech is in the range of approximately 60-240 Hz. The first four formants are at 500 Hz, 1,500 Hz, 2,500 Hz, and 3,500 Hz as disclosed in U.S. Pat. No. 5,459,813.

U.S. Pat. No. 4,454,609 discloses having the consonants undergo amplification.

U.S. Pat. No. 5,553,151 discloses "forward masking", wherein weak consonants are temporarily masked by the preceding strong vowels. This patent discloses a relatively fast compressor with an "attack time" of approximately 10 msec., and a "release time" of approximately 75 to 150 msec.

A problem inherent in the known systems for improving the intelligibility of speech in audio signals is their relatively high complexity. That is, there is a high level of complexity in both the software requirement to calculate the individual algorithms and in the hardware requirement. On the other hand, in the simpler systems the audio signal is modified to such an extent that the speech no longer sounds natural. In addition, certain disturbances may be imparted on the speech signal in the simpler systems that may even work against improved intelligibility.

Therefore, there is a need for an apparatus and method of reduced complexity for improving the speech quality of audio signals. In addition, there is a need for an apparatus and method of improving the speech intelligibility of a relatively good audio signal with the volume unmodified. That is, a system wherein the intelligibility remains the same at low volume or that intelligibility is improved in the presence of ambient noise.

SUMMARY OF THE INVENTION

An audio input signal is amplified by a predetermined factor and filtered in a high-pass filter, wherein the corner frequency of the high-pass filter is adjusted so that the amplitude of a processed audio output signal is equal to or proportional to the amplitude of the audio input signal.

A circuit of the present invention enables the fundamental wave of a speech signal, which contributes little to intelligibility but possesses the highest energy, to be attenuated and the remaining signal spectrum of the audio signal to be correspondingly raised. In addition, the amplitude of the vowels (high amplitude, low frequency) can be lowered in the consonant-to-vowel transition range (low amplitude, high frequency) to reduce the so-called "backward masking." To accomplish this, the entire signal is raised by a factor g. This factor controls the strength of the signal improvement effect, usable values for the factor g ranging between approximately 1.5 and 4. The circuit/system of the present invention raises the higher-frequency components while lowering the low-frequency fundamental wave to the same degree so that the amplitude (or energy) of the audio signal remains unchanged. With regard to signal components of small amplitude, that is, consonants, the circuit lowers the corner frequency of the variable high-pass filter. For this reason, an offset may be added in the control element to the input signal, the offset being either fixed or proportional to the peak amplitude of the input-side audio signal.

In an alternative embodiment, the higher-frequency signal components in the audio signal are lowered. A low-pass filter before the variable high-pass filter allows disturbances in the signal to be suppressed.

In yet another alternative embodiment, the corner frequency $f_c$ of the variable high-pass filter is limited on the low side since the lowest frequency of speech is approximately 200 Hz. A lower corner frequency in the range of approximately 100 Hz to 120 Hz has proven to be useful.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
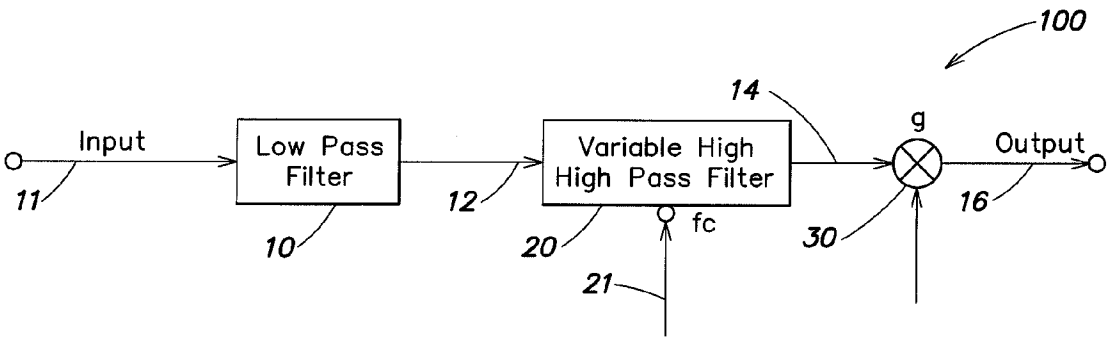
FIG. 1 is a block diagram illustration of an audio signal processing system.

FIG. 1 is a block diagram illustration of an audio signal processing system 100. The system includes a low pass filter (LPF) 10 that receives an audio signal on a line 11. The LPF 10 provides a low pass filtered signal on a line 12 to a variable high pass filter 20 having an adjustable corner frequency $f_c$. The variable high pass filter 20 receives a frequency control signal on a line 21 that sets the corner frequency $f_c$. The filter 20 provides a high pass filtered signal on a line 14 to an amplifier 30 having a gain g, which provides a processed audio signal on a line 16. The gain value g is adjustable and is preferably in the range of between approximately 1.5 and 4. Once an amplification factor is set, it is preferably not changed.

The value of the corner frequency $f_c$ of the variable high-pass filter 20 is controlled to improve the intelligibility of speech in the audio signal. If the amplitude (or energy) of the input signal on the line 11 is greater than the amplitude (or energy) of the processed audio signal on the line 16, then the value of the corner frequency $f_f$ is decreased. If the amplitude (or energy) of the input signal on the line 11 is less than the amplitude (or energy) of the processed audio signal on the line 16, the value of the corner frequency $f_f$ is increased. When the amplitudes of the input signal on the line 11 and the processed audio signal on the line 16 are the same or proportional by a predetermined factor, there is no further modification of the corner frequency value $f_c$.

Figure 2:
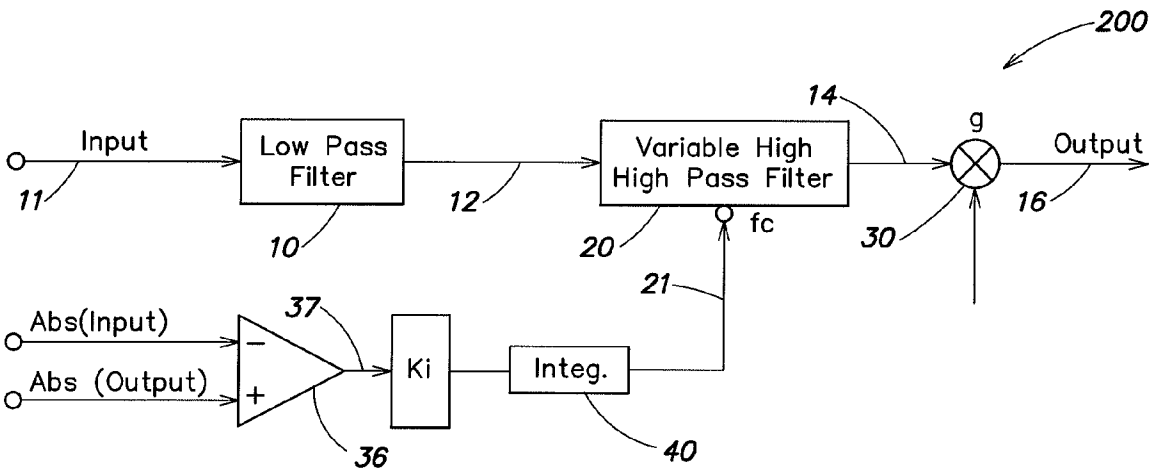
FIG. 2 is a block diagram illustration of an alternative embodiment audio signal processing system.

FIG. 2 is a block diagram illustration of an alternative embodiment audio signal processing system 200. This embodiment is essentially the same as the embodiment illustrated in FIG. 1, with the principal exception that a comparator 36 receives the absolute values of the signal on the line 12 and the processed audio signal on the line 16, and provides a difference signal on a line 37. The difference signal on the line 37 is multiplied by a scaling factor Ki, and the resultant product is input to an integrator 40, which provides the corner frequency control signal on the line 21.

Figure 3:
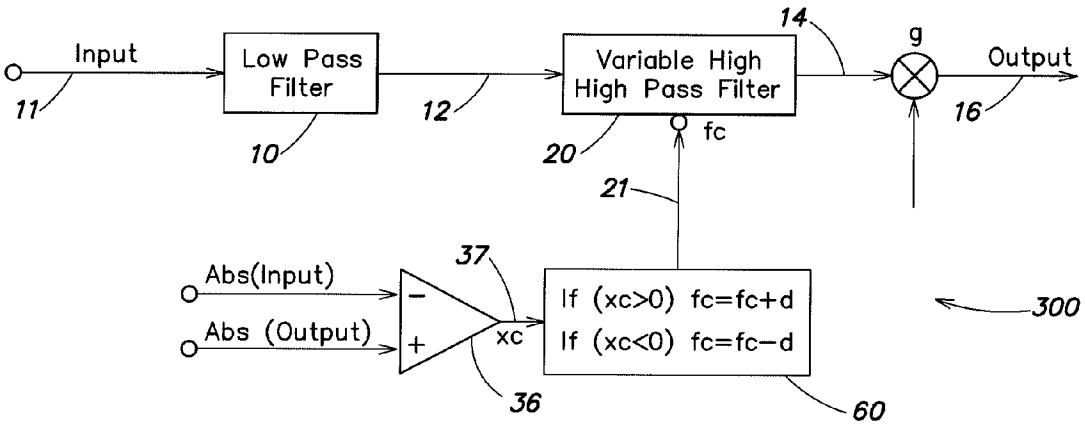
FIG. 3 is a block diagram illustration of another alternative embodiment audio signal processing system.

FIG. 3 is a block diagram illustration of another alternative embodiment audio signal processing system 300. The system illustrated in FIG. 3 is essentially the same as the system illustrated in FIG. 2, with the principal exception that the scaled integrator in FIG. 2 has been replaced with a digital circuit 60. The digital circuit 60 receives the difference signal on the line 37, and provides the corner frequency control signal on the line 21. The digital circuit increases the value of the corner frequency $f_c$ by a value d if the difference signal on the line 37 is greater than zero. The digital circuit 60 decreases the corner frequency $f_c$ by a value d if the difference signal on the line 37 is less than zero.

Figure 4:
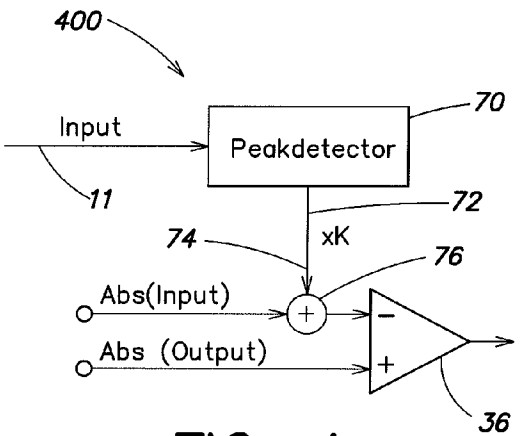
FIG. 4 is a block diagram illustration of an alternative embodiment comparison circuit.

FIG. 4 is a block diagram illustration of an alternative embodiment comparison circuit 400. In this embodiment, the input signal on the line 11 is input to a peak detector 70, which provides a peak detected signal value on a line 72, which may be multiplied by a factor K to provide an offset signal value on a line 74. The offset signal value is input to a summer 76 that also receives the absolute value of the input signal on the line 11. In yet another embodiment, the offset may simply be a constant value.

The audio signal processing circuit of the present invention allows the fundamental wave of the audio signal to be lowered, and the rest of the signal component to be raised. This function is achieved by the variable high-pass filter 20.

In the event a consonant follows a vowel in the speech signal, the circuit functions as follows: a vowel has a low frequency and a high amplitude. Conversely, a consonant has a high frequency and a low amplitude. The amplification factor value g is preferably adjusted to achieve an amplification of 6 dB. Based on the low-frequency vowel, the corner frequency of the variable high-pass filter 20 is adjusted to this low frequency. As a result, the fundamental wave is lowered to the point that the output amplitude is equal to the input amplitude of the audio signal, even though the selected amplification is 6 dB. If a consonant (higher frequency) now follows the vowel, this consonant is raised 6 dB since the corner frequency of the high-pass filter 20 is still set for the low frequency of the vowel. The consonant is masked to a lesser degree by the vowel. Only after a few milliseconds does the value of the corner frequency $f_c$ increase, thereby lowering the consonant as well so that the amplitude of the input signal is equal to the amplitude of the output signal of the processing segment.

During a transition from consonant to vowel, the circuit illustrated in FIG. 1 functions as follows. The high-pass filter 20 is adjusted to the frequency of the consonant, and as a result the amplitude of the input signal corresponds to the amplitude of the processed audio signal. If a vowel (low-frequency) now follows, the vowel is attenuated during the temporal transition due to the relatively high corner frequency $f_c$ of the high-pass filter 20, and the consonant is consequently not masked. After a few milliseconds the value of the corner frequency $f_c$ is adjusted based on the acting time of the loop so that the amplitude of the input signal corresponds to the amplitude of the output signal.

Figure 5:
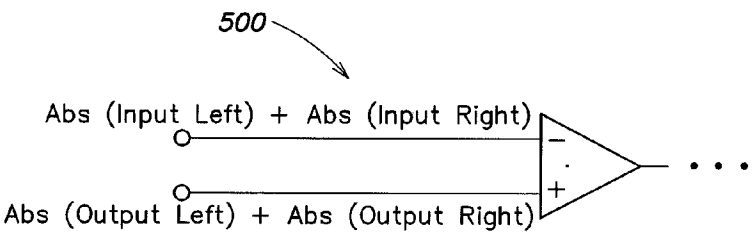
FIG. 5 is a block diagram illustration of another alternative embodiment comparison circuit.

In a stereo signal, it is possible either to have each channel use its own control as described above, or the channels may use a common control. For example, FIG. 5 is a block diagram illustration of another alternative embodiment comparison circuit 500. In this case, for example the sum of the signal values Abs(Input_Left) and Abs(Input_Right) is applied to the inverting input of the comparator, and the sum of the signal values Abs(Output_Left) and Abs(Output_Right) is applied to the non-inverting input to the comparator. The audio path (i.e., high-pass, low-pass, gain) is computed separately for left and right, but the high-pass filters have the same corner frequency $f_c$.

Although the present invention has been shown and described with respect to several preferred embodiments thereof, various changes, omissions and additions to the form and detail thereof, may be made therein, without departing from the spirit and scope of the invention.

What is claimed is:

1. A circuit for improving the intelligibility of an audio signal containing speech in which frequency and/or amplitude components of the audio signal are modified according to predetermined parameters, the circuit comprising:

a high-pass filter that filters the audio signal to provide a filtered audio signal that is amplified by a predetermined factor to provide an amplified filtered audio signal, a corner frequency $f_c$ of the high-pass filter being operably adjustable such that the amplitude of the amplified filtered audio signal is proportional to the amplitude of the audio signal, where the predetermined factor is between 1.5 and 4.

2. A circuit for improving the intelligibility of an audio signal containing speech in which frequency and/or amplitude components of the audio signal are modified according to predetermined parameters, the circuit comprising:

a high-pass filter that filters the audio signal to provide a filtered audio signal that is amplified by a predetermined factor to provide an amplified filtered audio signal, a corner frequency $f_c$ of the high-pass filter being operably adjustable such that the amplitude of the amplified filtered audio signal is proportional to the amplitude of the audio signal, where the corner frequency $f_c$ is reduced whenever the amplitude of the audio signal is greater than the amplitude of the amplified filtered audio signal, and where the corner frequency $f_c$ is increased whenever the amplitude of the audio signal is smaller than the amplitude of the amplified filtered audio signal.

3. The circuit of claim 2, where any change in the corner frequency $f_c$ is incremental.

4. A circuit for improving the intelligibility of an audio signal containing speech in which frequency and/or amplitude components of the audio signal are modified according to predetermined parameters, the circuit comprising:

a high-pass filter that filters the audio signal to provide a filtered audio signal that is amplified by a predetermined factor to provide an amplified filtered audio signal, a corner frequency $f_c$ of the high-pass filter being operably adjustable such that the amplitude of the amplified filtered audio signal is proportional to the amplitude of the audio signal, where the corner frequency $f_c$ is variable in the range between approximately 100 Hz and 1 kHz.

5. A circuit for improving the intelligibility of an audio signal containing speech in which frequency and/or amplitude components of the audio signal are modified according to predetermined parameters, the circuit comprising:

a high-pass filter that filters the audio signal to provide a filtered audio signal that is amplified by a predetermined factor to provide an amplified filtered audio signal, a corner frequency $f_c$ of the high-pass filter being operably adjustable such that the amplitude of the amplified filtered audio signal is proportional to the amplitude of the audio signal, where a lower value of the corner frequency $f_c$ is between 100 Hz and 120 Hz.

6. A circuit for improving the intelligibility of an audio signal containing speech in which frequency and/or amplitude components of the audio signal are modified according to predetermined parameters, the circuit comprising:

a high-pass filter that filters the audio signal to provide a filtered audio signal that is amplified by a predetermined factor to provide an amplified filtered audio signal, a corner frequency $f_c$ of the high-pass filter being operably adjustable such that the amplitude of the amplified filtered audio signal is proportional to the amplitude of the audio signal;

a low-pass filter connected before the high-pass filter, where the low-pass filter has a cut-off frequency of approximately 6 kHz.

7. A circuit for improving the intelligibility of an audio signal containing speech in which frequency and/or amplitude components of the audio signal are modified according to predetermined parameters, the circuit comprising:

a high-pass filter that filters the audio signal to provide a filtered audio signal that is amplified by a predetermined factor to provide an amplified filtered audio signal, a corner frequency $f_c$ of the high-pass filter being operably adjustable such that the amplitude of the amplified filtered audio signal is proportional to the amplitude of the audio signal; and a comparator connected to a control input of the high-pass filter to modify the corner frequency $f_c$, the audio signal being applied to a first input of the comparator and the amplified filtered audio signal being applied to a second input of the comparator.

8. The circuit of claim 7, further comprising an integrator connected between the control input of the high-pass filter and an output of the comparator.

9. The circuit of claim 7, further comprising a digital circuit to change the corner frequency $f_c$ in steps and connected between the control input of the high-pass filter and the output of the comparator.

10. The circuit of claim 9, where an offset value is added to the audio signal at the first input of the comparator.

11. The circuit of claim 10, where the audio signal is a stereo signal, and a sum of a pair of the audio signals is fed to the first input of the comparator, and a sum of a pair of the amplified filtered audio signals is fed to the second input of the comparator.

12. An audio signal processing system, comprising:

a high-pass filter that receives an audio signal and provides a filtered audio signal, where the high-pass filter has a corner frequency that is operably adaptive with a value controlled by a frequency control signal;

an amplifier having a selectable gain value that is operably adaptive to receive and amplify the filtered audio signal to provide an amplified filtered audio signal; and means, responsive to the audio signal and the amplified filtered audio signal, for providing the frequency control signal to control the value of the corner frequency such that the amplitude of the amplified filtered audio signal is a selected proportion of the amplitude of the audio signal.

13. The audio signal processing system of claim 12, where the selected proportion is equal.

14. The audio signal processing system of claim 12, where the selectable gain value is greater than one.

15. The audio signal processing system of claim 12, where the value of the corner frequency is reduced when the amplitude of the audio signal is greater than the amplitude of the amplified filtered audio signal, and where the value of the corner frequency is increased when the amplitude of the audio signal is smaller than the amplitude of the amplified filtered audio signal.

16. The audio signal processing system of claim 12, further comprising a low-pass filter that receives and filters the audio signal and provides a signal indicative thereof to the high-pass filter.

17. The audio signal processing system of claim 12, where the means for providing comprises a comparator that compares the audio signal to the amplified filtered audio signal and provides a difference signal that is processed to generate the frequency control signal.

18. The audio signal processing system of claim 17, where the means for providing further comprises an integrator that receives the difference signal and provides the frequency control signal.

19. The audio signal processing system of claim 18, where the difference signal is multiplied by a predetermined gain factor before being input to the integrator.

20. The audio signal processing system of claim 17, where the means for providing further comprises a digital circuit that receives the difference signal and provides the frequency control signal such that when the value of the difference signal is greater than zero the frequency control signal is set so the value of the corner frequency is increased, and where when the value of the difference signal is less than zero then the value of the frequency control signal is set so the corner frequency is reduced.

21. The audio signal processing system of claim 17, further comprising a peak detector that receives the audio signal, and provides an offset signal that is added to the audio signal at an input of the comparator.

22. The audio signal processing system of claim 12, further comprising a comparator, where the audio signal is a stereo signal, a sum of a corresponding pair of the audio signals is provided to a first input of the comparator, and a sum of a pair of the amplified filtered audio signals is provided to a second input of the comparator.

* * * * *